US012807296B2

(12) United States Patent
Curcio

(10) Patent No.: US 12,807,296 B2
(45) Date of Patent: Nov. 24, 2026

(54) AUTOPILOT SYSTEM FOR MARINE VESSELS

(71) Applicant: Mario Curcio, Hochdorf (CH)

(72) Inventor: Mario Curcio, Hochdorf (CH)

( * ) Notice: Subject to any disclaimer, the term of this patent is extended or adjusted under 35 U.S.C. 154(b) by 533 days.

(21) Appl. No.: 18/276,023

(22) PCT Filed: Feb. 20, 2022

(86) PCT No.: PCT/EP2022/054169
§ 371 (c)(1),
(2) Date: Aug. 5, 2023

(87) PCT Pub. No.: WO2022/175502
PCT Pub. Date: Aug. 25, 2022

(65) Prior Publication Data

US 2024/0092472 A1 Mar. 21, 2024

(30) Foreign Application Priority Data

Feb. 21, 2021 (EP) ..... 21020083

(51) Int. Cl.
*B63H 25/04* (2006.01)
*B63H 25/06* (2006.01)

(52) U.S. Cl.
CPC ..... *B63H 25/04* (2013.01); *B63H 25/06* (2013.01); *B63H 2025/045* (2013.01); *B63H 2025/066* (2013.01)

(58) Field of Classification Search
CPC .. B63H 25/04; B63H 25/06; B63H 2025/045; B63H 2025/066; B63H 25/42; B63B 79/40
See application file for complete search history.

(56) References Cited

U.S. PATENT DOCUMENTS

| | | | | |
|---|---|---|---|---|
| 10,078,332 | B2 | 9/2018 | Tamura et al. | |
| 10,671,073 | B2 | 6/2020 | Arbuckle et al. | |
| 2010/0136857 | A1 | 6/2010 | Goudsmit | |
| 2016/0001861 | A1* | 1/2016 | Peddie ..... | B63H 25/04 114/39.11 |

(Continued)

FOREIGN PATENT DOCUMENTS

EP 1960855 B1 8/2014

*Primary Examiner* — Navid Z. Mehdizadeh
*Assistant Examiner* — Shelley Marie Osterhout
(74) *Attorney, Agent, or Firm* — Taft Stettinius & Hollister LLP

(57) ABSTRACT

An autopilot system for automatically steering a marine vessel is disclosed. The marine vessel comprises two electric motors connected to respective propulsors, two rudders, a rudder steering mechanism and a navigation system for determining the vessel position with respect to an intended course. The autopilot system can operate according to one or more autopilot modes comprising at least a motor steering autopilot mode wherein the autopilot system is configured to automatically control the rudder steering mechanism in order to lock the rudders at a fixed angle, and based on a feedback from the navigation system to independently and dynamically adjust power supply to each of the propulsors by independently and dynamically regulating electric power supply to the respective electric motors in order to maintain the vessel on course.

15 Claims, 5 Drawing Sheets

(56) References Cited

U.S. PATENT DOCUMENTS

| | | | | |
|---|---|---|---|---|
| 2018/0244362 | A1* | 8/2018 | Nolan | B63H 25/02 |
| 2019/0039708 | A1* | 2/2019 | Hayes | B63H 25/24 |
| 2020/0062368 | A1* | 2/2020 | Remøy | B63H 25/52 |
| 2020/0115012 | A1* | 4/2020 | Orivuori | B63H 25/38 |

* cited by examiner

[Fig. 1]
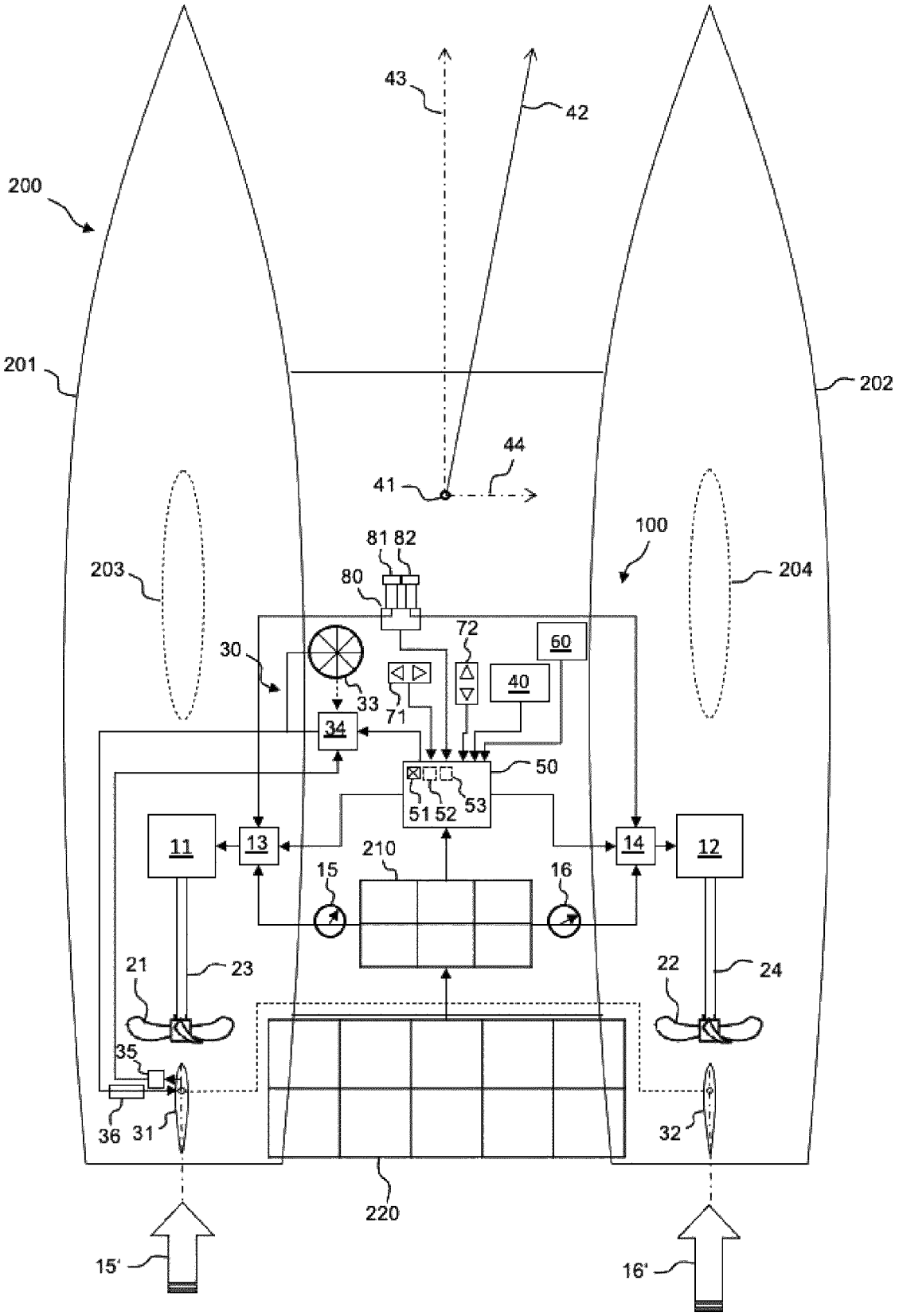

[Fig. 2]
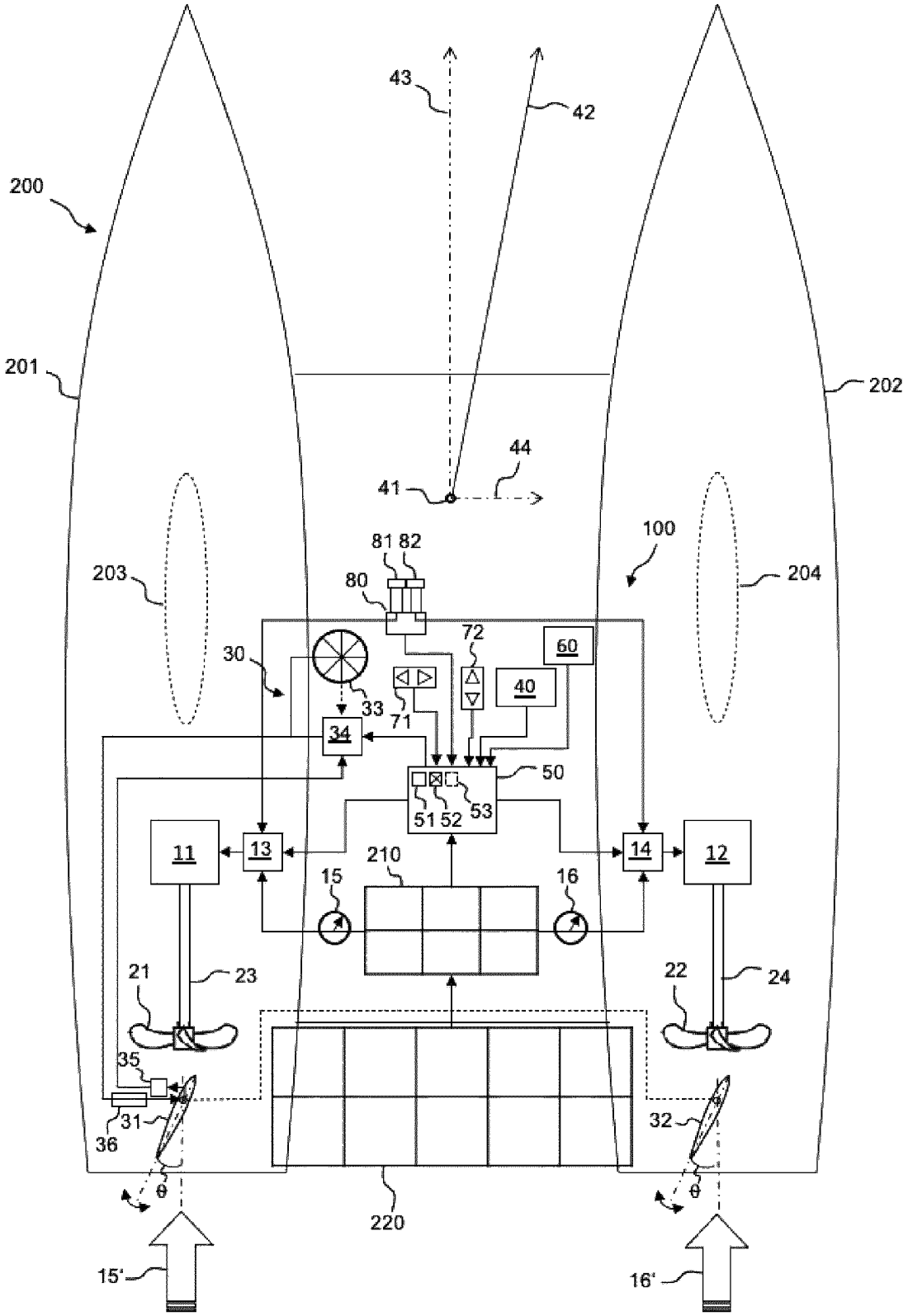

[Fig. 3]
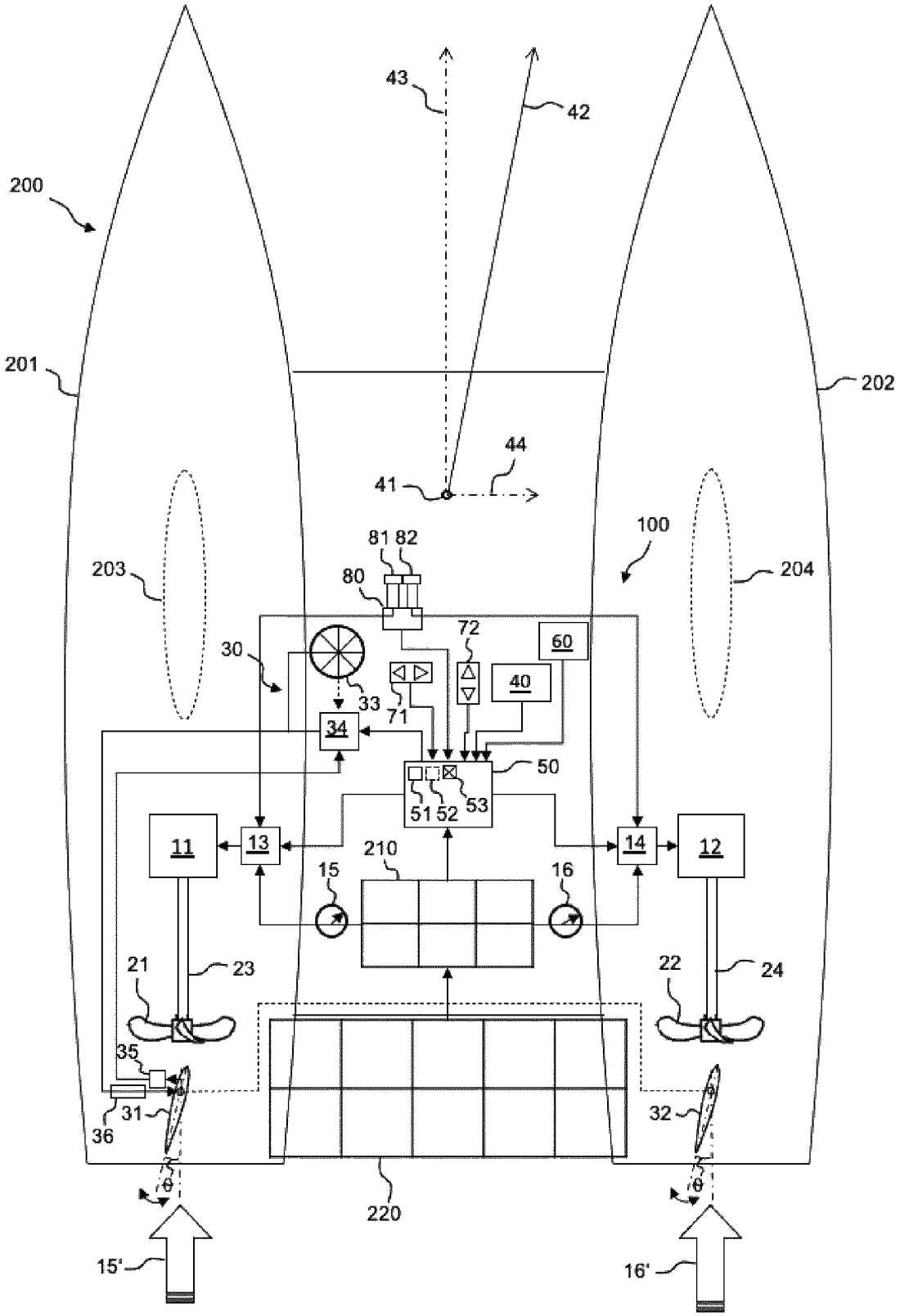

[Fig. 4]
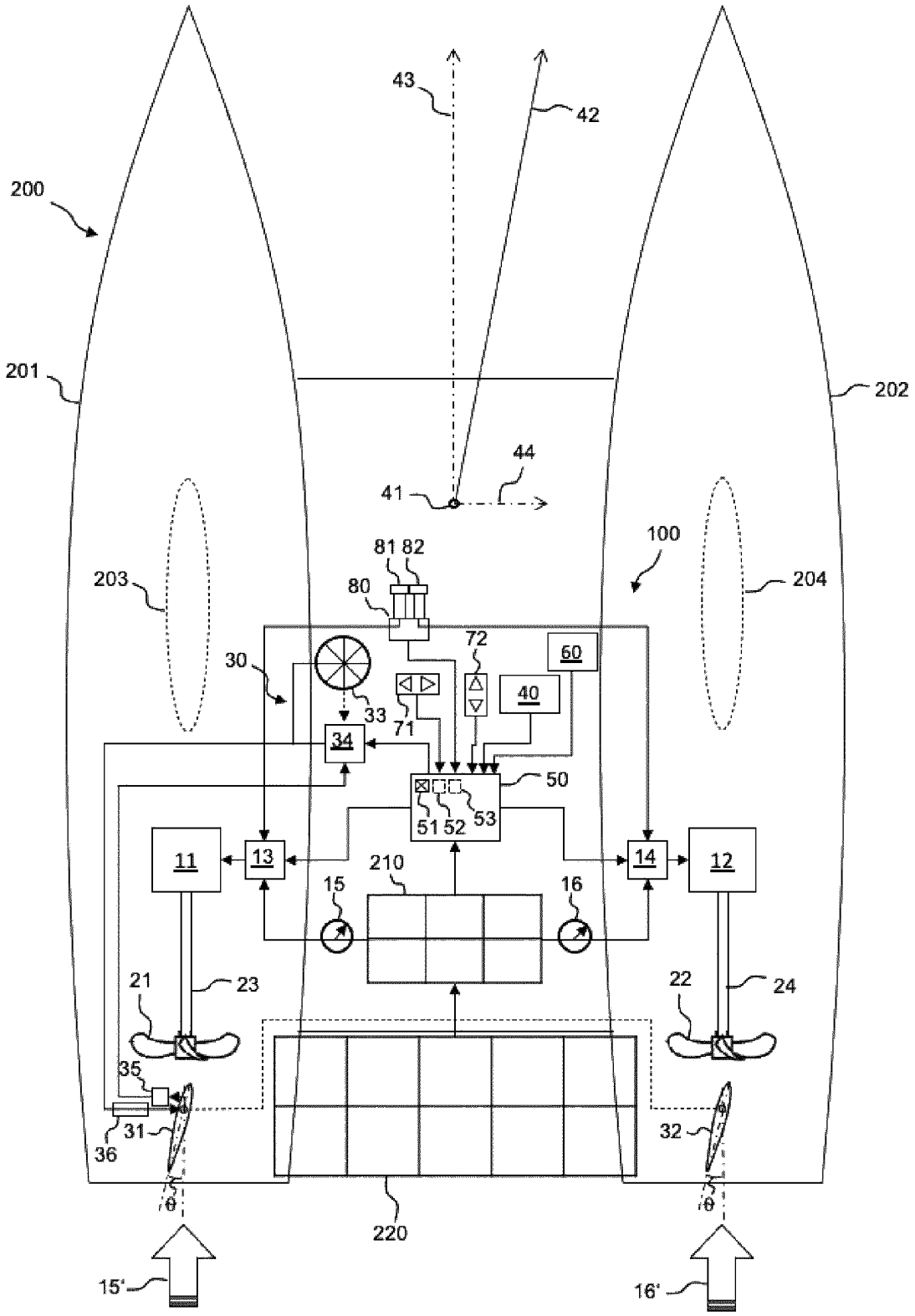

[Fig. 5]
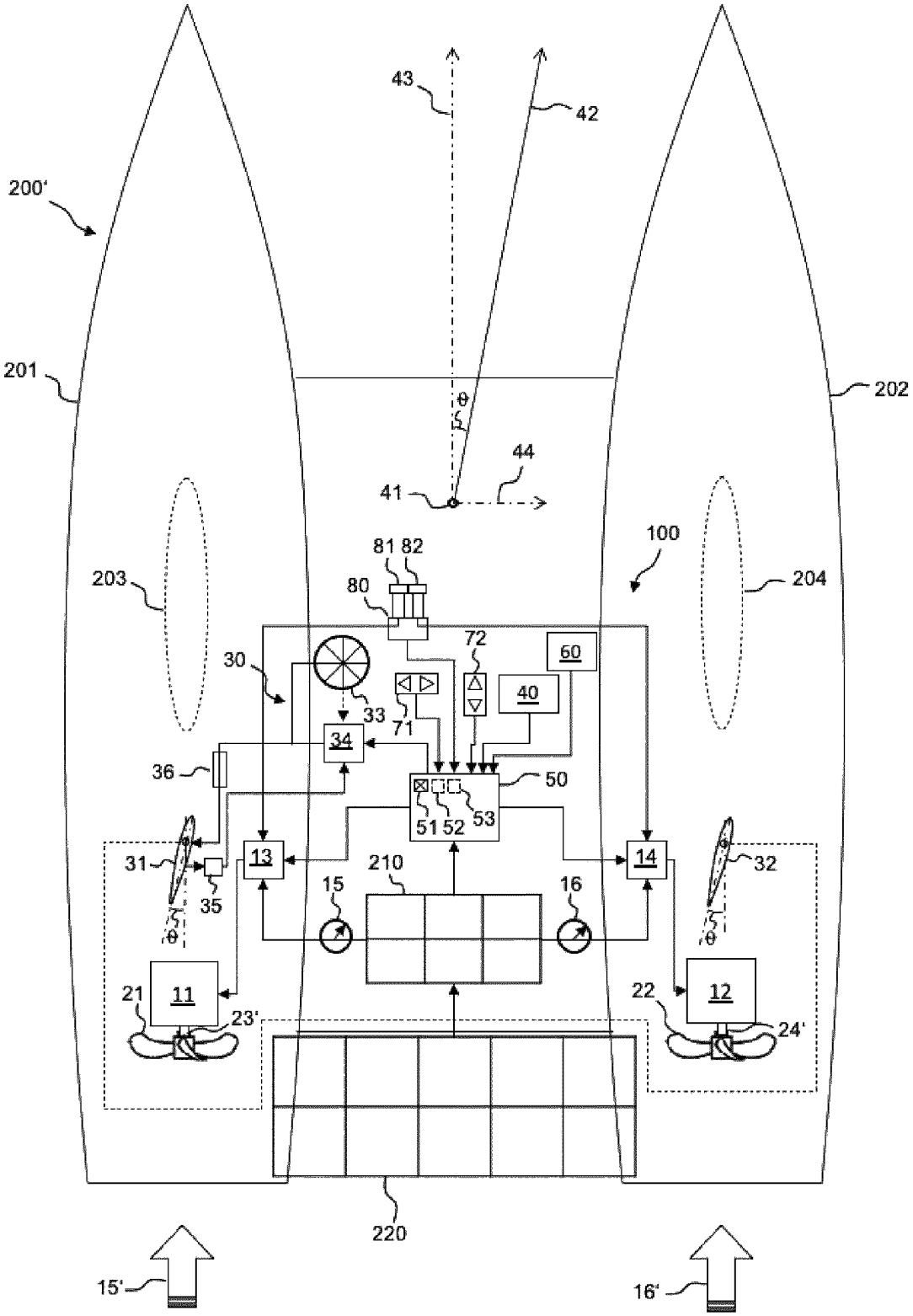

AUTOPILOT SYSTEM FOR MARINE VESSELS

FIELD OF THE INVENTION

The present disclosure relates to an autopilot system for automatically steering a marine vessel and to a marine vessel comprising such an autopilot system.

BACKGROUND

Vessels such as marine vessels can be subject to variable marine and weather conditions, such as wind, water current, wave effect, that may apply significant side forces and moments to the vessels when underway, causing the vessels to drift and hence to deviate from an intended course. Thus, marine vessels typically make use of an autopilot system based on feedback from a navigation system in order to stay on course, especially for longer cruising distances. Autopilot systems typically operate by automatically controlling rudder deflection in order to compensate for the drift caused by the above factors.

Marine vessels may be provided with various propulsion systems. The mostly used propulsion systems to date are based on combustions engines, in particular diesel engines. Most vessels have a single engine connected to a single propeller and direction is controlled by rudder steering using either one or two rudders. Other marine vessels may be provided with two engines and also two rudders on the port side and on the starboard side respectively. This is typical especially for multihull vessels such as catamarans.

Other marine vessels may not have a rudder at all. In order to control direction, the propulsion systems can be rotatable about a steering axis, e.g. comprising a saildrive transmission system comprising a vertical rotatable intermediate shaft extending downward through a bottom surface of the hull or hulls of the marine vessel. Similarly, rotating outboards engines hanging at the stern of the vessel can be used in other types of vessels. Such rotating propulsion systems may be however not suitable or not preferred for some types of vessels, they can be structurally more complex and require more maintenance compared to propulsion systems with fixed axes, which however require an additional rudder steering system for direction control.

Some other special and rare marine vessels such as amphibious vessels do not typically have a rudder either nor propulsion systems with rotatable axis. In order to control direction, a separate shift and throttle system for each engine may be used, even in autopilot mode, as disclosed e.g. in US 2018/0244362 A1.

Accurate and fine control of individual combustion engines and of the power transmitted to each propulsor is however very hard to achieve. With the typical mechanical transmission systems, for example, it is not possible to achieve a minimum speed lower than several hundreds revolutions per minute (rpm) for each propeller. Also, each minimal change in power typically results in a change of several rpm in addition to being poorly precise and poorly reproducible.

Moreover, mismatched engine speeds while cruising can cause additional drag and reduced engine efficiency, increased engine vibrations and reduced cruising comfort, as well as steer-offs during acceleration and deceleration. Thus, more advanced and efficient autopilot systems actually use a synchronization system that on the contrary tries to match the engine speeds during cruising, thus reducing the above problems and increasing cruising comfort, while direction control is based on rudder deflection control.

There is however another problem induced by rudder deflection in general, the greater the deflection the greater the problem. This is the generation of an additional drag force and resistance that causes either a reduction of vessel velocity or an increase of power consumption in order to maintain the desired vessel velocity.

GENERAL DESCRIPTION

In view of the above background, an autopilot system for automatically steering a marine vessel is herein disclosed that enables precise direction control of the vessel while reducing drag force and hence reducing power consumption at a certain vessel velocity or increasing vessel velocity at a certain power consumption, and while preserving the option to use a rudder steering mechanism for direction control at least in manual mode and, according to some embodiments, also in other situations when this may be more convenient. Other advantages will become apparent from the following description.

A marine vessel comprising such an autopilot system and presenting the same advantages is herein also disclosed.

In particular, the marine vessel comprises two electric motors respectively connected to a port side propulsor and to a starboard side propulsor, a port side rudder and a starboard side rudder and a rudder steering mechanism, a navigation system for determining the vessel position with respect to an intended course, and an autopilot system for automatically steering the marine vessel.

More in particular, the autopilot system of the present disclosure is configured to operate according to one or more autopilot modes, comprising at least a motor steering autopilot mode where the autopilot system is configured to automatically control the rudder steering mechanism in order to lock the rudders at a fixed angle, and based on a feedback from the navigation system to independently and dynamically adjust power supply to each of the port side propulsor and of the starboard side propulsor by independently and dynamically regulating electric power supply to the respective electric motors in order to maintain the vessel on course.

A "marine vessel" according to the present disclosure is a vessel such as a boat, a yacht, a ship, a ferry or any other floating vessel, either monohull or multihull, adapted for navigation on water, such as ocean, sea, lake, river, regardless of its use, e.g. as a leisure vessel, or for commercial or dedicated use, e.g. as a charter yacht, a fishing boat, a ferry for transportation of people and/or other vehicles, a ship for transportation of goods, etc. . . . . In particular, the marine vessel of the present disclosure is a vessel provided with an electric propulsion system as sole propulsion system or as main or complementary propulsion system, e.g. in addition to a wind propulsion system in case of sailing boats, and/or in addition to a combustion-based propulsion system in case of hybrid systems. More particularly, the marine vessel of the present disclosure is a vessel provided with at least two independently controllable electric motors respectively connected to a port side propulsor and to a starboard side propulsor. According to an embodiment the marine vessel is a catamaran provided with two hulls, at the port side and starboard side respectively, and an electric motor connected to a respective propulsor for each hull.

The yachting industry like the automobile industry is evolving towards more ecological and sustainable solutions, which are based on the gradual replacement of combustion engines with electric motors and of fuel tanks with battery packs for energy storage. In particular, the continuous developments in the battery industry, especially with respect to storage capacity, safety, recharging speed, and decreasing costs, make this change more and more valuable and logical. Unlike for the automobile industry, where battery recharging requires connection to an electric power grid, yachts and especially those with a larger beam to length ratio, such as catamarans, can offer sufficient surface for installing independent and renewable energy sources such as solar panels and/or wind turbines for autonomous battery recharging. Current designs such as those from a leading manufacturer of solar yachts (Silent-Yachts) manage to achieve an energy production of e.g. 17 Kwp on a 60-feet catamaran and 26 Kwp on a 80-feet catamaran, with solar panels alone, which can provide unlimited cruising range at certain vessel velocities, e.g. of about 6-8 Knots. A combustion-based generator is typically provided as a backup solution for battery recharging in case of prolonged cast sky over several days or when increased velocity is required over a prolonged time. The autopilot system of the present disclosure is particularly suitable for this kind of marine vessels.

An advantage of electric motors, unlike combustion engines, is the possibility to achieve a fine control of electric power supply, resulting in fine control of the motor speed in terms of revolution per minute (rpm), without complex mechanical transmissions having fixed gear ratios, hence resulting in the possibility to fine control the speed of the propulsors, with a precision of up to 1 rpm or even less and in a reproducible manner, when electronically controlled. It is thus possible to control each electric motor independently so that the difference in propulsor speed can be that small if needed and adjusted dynamically as needed in any rpm range, even at low speeds of a few rpm.

The term "propulsor" may refer to any rotatable propulsion device, which transforms rotational power into linear thrust by acting upon water. According to the present disclosure the propulsors are typically propellers and they are typically located aft at a fixed position and angle with respect to the vessel hull. According to an embodiment, the propellers are connected to the respective electric motors via respective propeller shafts through the hull(s) of the vessel.

The port side rudder and the starboard side rudder may be located aft or forward with respect to the port side propulsor and the starboard side propulsor respectively. The rudder steering mechanism typically comprises a mechanical and/or hydraulic interconnection between the rudders and at least one steering wheel, at least for larger vessels, for manually adjusting the rudders angle (deflection) and hence the vessel direction or heading. Other smaller vessels may use a steering bar instead of a steering wheel for example. In alternative or in addition, electronic means for rudder control may be used, e.g. electronic steering systems making use of electronic levers, joysticks and the like or other digital directional commands configured to send an electric input or signal to one or more rudder drive units and to cause a movement of the rudders by the drive unit(s).

The term "navigation system" may refer to any electronic system for determining and/or monitoring the vessel position with respect to an intended course. The navigation system is typically a satellite-based navigation system such as a global positioning system (GPS), a global navigation satellite system (GLONASS) or combinations thereof, that can provide real time positioning and also determination of velocity. It typically includes also an electronic chart system for visually displaying and monitoring the vessel position on a chart and provides the possibility to set a destination and to monitor the advancement to the set destination. Other types of navigation system can be in principle also used in alternative or in addition such as a gyrocompass or a fluxgate compass for heading monitoring.

An "autopilot system" as herein disclosed is an electronically controlled device, which can be configured to operate according to one or more autopilot modes, in order to automatically steer and maintain the vessel on course. According to the motor steering autopilot mode, the autopilot system is configured to automatically control the rudder steering mechanism in order to adjust and lock the rudders at a fixed angle, and based on a feedback from the navigation system to independently and dynamically adjust power supply to each of the port side propulsor and of the starboard side propulsor by independently and dynamically regulating electric power supply to the respective electric motors in order to maintain the vessel on course. "Adjusting power supply to the propulsors" means adjusting the rotational power transmitted by the respective motors to the propulsors and resulting in a respective change of propulsor speed, measured typically in rpm. The autopilot system is electronically connected also to the rudder steering mechanism and is configured to control power supply to one or more rudder drive units, based on a feedback from one or more rudder angle sensor(s) and/or based on drive unit position feedback, in order to adjust and/or lock the rudders angle, besides being connected to power control units of the electric motors.

According to an embodiment, the autopilot system is configured to maintain a constant average vessel velocity and/or a constant average total electric power consumption.

The term "average vessel velocity" as used herein refers to the average velocity that a vessel is required to maintain in order to cover a certain distance in a certain period of time and not to the actual vessel velocity at any given point in the same period of time, as this may vary depending on actual conditions, such as actual wind speed and direction, water current and waves at each particular point in time. Thus, maintaining the average vessel velocity constant means maintaining a certain vessel velocity about constant over a certain distance or until a willful change of vessel velocity occurs. The vessel velocity is typically measured as speed over ground (SOG) with respect to the bottom of the sea and as determined by the navigation system. This is typically different from the vessel velocity with respect to the water surface, as measured by other sensors, the difference being mostly due to the effect of water current. The average vessel velocity may however refer to any of these two speeds. The unit of measure is typically in nautical miles per hour or knots.

The term "average total electric power consumption" as used herein refers to the cumulative electric power drainage, typically measured in ampere hour (Ah) or watt hour (Wh), by both electric motors over a certain distance and/or a certain period of time, whereas the individual power consumption of each electric motor may differ between the two electric motors depending on the effective use of each motor by the autopilot system during the same time and distance, and whereas the actual total electric power consumption at any given point in the same period of time may vary depending on actual vessel velocity and actual conditions, such as actual wind speed and direction, water current and waves at each particular point in time. Thus maintaining the average total electric power consumption constant means maintaining a pre-defined power consumption about constant over a certain distance or until a willful change of vessel velocity occurs. One way to maintain the average total electric power consumption constant is to regulate power supply to the electric motors such as an increase of power supply to one motor is compensated by a decrease of power supply of the same amount to the other motor.

The autopilot system may be configured to automatically adapt the average vessel velocity based on the average total electric power consumption and the power reserve such as at least to decrease the average vessel velocity if the power reserve is insufficient to reach the set destination at current average total electric power consumption and/or optionally to increase the vessel velocity if the power reserve allows it.

Numerous algorithms can be found in the literature to calculate hydrodynamic forces on a rudder, including also additional resistance, such as e.g. in [*Ships and marine technology. Guidelines for the assessment of speed and power performance by analysis of speed trial data. ISO* 15016, 2015]. These take into account shape, size and position of the rudders, shape, size and position of the propellers among numerous other factors. It is for example known that the forces and moments acting on a rudder located aft (behind) a propeller are different with respect to the forces and moments acting on a rudder being located forward with respect to the propeller.

According to an embodiment, the fixed angle at which the autopilot system locks the rudders is an angle at which the rudders are parallel to the longitudinal axis of the vessel or bow heading or is an angle at which the rudders are parallel to the intended course.

According to an embodiment, the fixed angle is an angle at which the rudders are parallel to the longitudinal axis of the vessel or bow heading if the rudders are located aft with respect to the propulsors and/or if the vessel comprises a port side keel and a starboard side keel aligned with the respective rudders and propulsors. This angle is typically the angle at which the rudders cause the least resistance in such conditions.

According to an embodiment, the fixed angle is an angle at which the rudders are parallel to the intended course or true heading if the rudders are located forward with respect to the propulsors. In this position the propulsors have less or no direct influence on the forces acting on the rudders when the vessel is moving forwards. As the vessel heading may be different from the true heading or actual course in order to compensate for the drift caused by actual conditions such as wind, water current and waves, this rudder angle may be the angle at which the rudders cause the least resistance in such conditions.

According to an embodiment, the fixed angle is an empirically determined angle at which effective average total electric power consumption is minimum at a certain vessel velocity for the intended course. This angle may be automatically determined by the autopilot system by e.g. sequentially testing different rudder angles (scanning across an angle range) and determining the total electric power consumption at each angle. This may be convenient in case of e.g. larger drifts or particular wave conditions, where the benefits of a complementary rudder action, despite the additional resistance generated, may nevertheless result in less power consumption. The autopilot system may be configured to maintain the determined angle fixed, until a willful change of vessel velocity or change of intended course occurs or if the electric power consumption significantly changes along the course, in which case a new angle may be determined and fixed.

According to an embodiment, the autopilot system is responsive to a manual change of vessel velocity and/or change of intended course by re-adjusting the power supply to each of the port side propulsor and of the starboard side propulsor, while maintaining the rudders angle fixed.

According to an embodiment, the dynamic power adjustment is further based on any one or more actual data from any one or more additional sensors or data sources, the data including any one or more of wind direction, water current direction, wave direction, swell, depth, yaw, pitch, roll.

According to an embodiment, the marine vessel further comprises a throttle mechanism comprising two independent control units for individual manual control of power supply to each electric motor, wherein individual manual control of power supply to each electric motor is disabled when the autopilot system is activated. In particular, the throttle mechanism may comprise a speed and direction (forward—backward) control handle for each electric motor, which may be particularly useful when maneuvering the vessel in limited spaces such as harbors and bays, and for mooring. In alternative or in addition the throttle mechanism may comprise electronic push commands, e.g. digital buttons for incremental speed change and direction change. Alternatively, manual control may be further simplified by a combined mechanism such as a joystick.

According to an embodiment, when the autopilot system is activated, only manual control of vessel velocity is enabled though the throttle mechanism. This means that when the autopilot system is activated, at least in the motor steering autopilot mode, it is not possible to manually control each motor independently but only jointly, in order to increase or reduce total electric power supply and hence increase or reduce the average vessel velocity. This may be achieved for example by electronically locking the independent control units such that they can be actuated only together or in a manner that acting on one of them causes the same action on both electric motors.

According to an embodiment, the autopilot system comprises an autopilot mode selection function and is further configured to operate according to one or more additional autopilot modes selected from a rudder steering autopilot mode and a hybrid steering autopilot mode.

According to the rudder steering autopilot mode the autopilot system is configured to maintain the electric power supply to each of the electric motors constant and to automatically and dynamically control the rudder steering mechanism in order to maintain the vessel on course to the set destination and/or on the intended course. This conventional autopilot mode can be more convenient in case e.g. the vessel is cruising by wind propulsion under sail and with the electric motors off, whereas the motor steering autopilot mode can be more convenient for the same vessel cruising by motor propulsion, e.g. in absence of wind or in case of insufficient or unfavorable wind and/or marine conditions. Alternatively, even in case the vessel is cruising by wind propulsion under sail, the motor steering autopilot mode may be used with the minimum power necessary for direction control only, while the main propulsion power is still provided by wind, in which case an increase of vessel velocity may be expected, also due to the reduced drag caused by the rudders. The rudder steering autopilot mode may be also selected in connection to the use of only one of the two electric motors, e.g. in case of malfunction of one of the electric motors, thus acting as a backup autopilot mode when only one motor is functioning and automatic direction control could not be obtained otherwise.

According to an embodiment, the power supply to both electric motors is the same in the rudder steering autopilot mode. The power supply to each electric motor may be however different, although constant, e.g. as a complementary action to the action of the rudder steering mechanism in order e.g. to reduce the angle range of rudder deflection, in which case the autopilot system may be configured to determine the optimal difference in power supply between the electric motors in order to maintain the vessel on course with minimal rudder steering deflections.

According to the hybrid steering autopilot mode the autopilot system is configured to independently and dynamically regulate electric power supply to the respective electric motors and also to automatically and dynamically control the rudder steering mechanism in order to maintain the vessel on course. This autopilot mode may be more convenient when for example the conditions affecting the vessel course are less steady, e.g. in more wavy conditions, and the consequent continuous adjustment of power to the electric motors may cause excessive strain to the motors and/or to the electronic control, whereas using only the rudder steering mechanism may cause unnecessary resistance and higher power consumption. Thus, a hybrid mode which uses both rudder deflection control, e.g. in a reduced angle range to minimize resistance, and motor direction control, e.g. with reduced power adjustment range to minimize strain, could be the best compromise in such cases while still reducing power consumption.

Typically, manual control of the rudder steering mechanism is disabled when the autopilot system is activated, in any autopilot mode, and enabled as soon as the autopilot system is deactivated. The option to use a rudder steering mechanism for direction control in manual mode may be convenient in many circumstances like when moving the vessel for short distances or maneuvering the vessel in small spaces, or in case of frequent changes of direction, e.g. in competitive sport activities like regattas or leisure sailing, or when it is desired or more practical for any other reason. The option to use a rudder steering mechanism for direction control in manual mode may be also important in cases of e.g. malfunction of the autopilot system and/or of one or both motors, or when the autopilot system fails to maintain the vessel on course, e.g. in case of extreme marine and weather conditions.

The present disclosure is also related to a marine vessel comprising the autopilot system according to any of the embodiments described.

According to an embodiment, the marine vessel further comprises a rechargeable battery pack as power supply for the electric motors and at least one renewable energy source for recharging the battery pack. According to an embodiment the battery pack comprises lithium-ion cells, but any other types of rechargeable batteries may in principle be used. According to an embodiment, the at least one renewable energy source is a photovoltaic system.

Other and further objects, features and advantages will appear from the following description of exemplary embodiments and accompanying drawings, which serve to explain the principles more in detail.

BRIEF DESCRIPTION OF THE DRAWINGS

FIG. 1 shows schematically a marine vessel comprising an autopilot system in a first autopilot mode.

FIG. 2 shows schematically the same marine vessel of FIG. 1 with the autopilot system in a second autopilot mode.

FIG. 3 shows schematically the same marine vessel of FIG. 1 and FIG. 2 with the autopilot system in a third autopilot mode.

FIG. 4 shows schematically the same marine vessel of FIG. 1 with the autopilot system in the first autopilot mode, but according to a different embodiment.

FIG. 5 shows schematically a variant of the marine vessel of FIG. 1 with the autopilot system in the same first autopilot mode as in FIG. 1, but configured in a different manner.

Skilled artisans appreciate that elements in the figures are illustrated for simplicity and clarity and have not necessarily been drawn to scale. For example, the dimensions of some of the elements in the figures may be exaggerated relative to other elements whereas other elements may have been left out or represented in a reduced number in order to enhance clarity and improve understanding of the embodiments of the present disclosure.

DETAILED DESCRIPTION

FIG. 1 shows schematically a marine vessel 200 and in particular a catamaran with a port side hull 201 and a starboard side hull 202, comprising a port side electric motor 11 and a starboard side electric motor 12, respectively connected to a port side propeller 21 and to a starboard side propeller 22 via respective propeller shafts 23, 24, a rechargeable battery pack 210 as electric power supply for the electric motors 11, 12 and a photovoltaic system 220 as renewable energy source for recharging the battery pack 210. The marine vessel 200 may optionally comprise a port side keel 203 and a starboard side keel 204, e.g. in some cases when the marine vessel 200 is a sailing vessel. In particular, the marine vessel 200 comprises a vessel steering system 100 comprising a port side rudder 31 and a starboard side rudder 32 connected to each other, so that they can be deflected simultaneously with the same angle, and a rudder steering mechanism 30 comprising a steering wheel 33, a rudder control unit 34 connected to one or more rudder drive units 36 and at least one rudder angle feedback sensor 35. The vessel steering system 100 further comprises a navigation system 40 for determining the vessel position 41 with respect to an intended course 42. The vessel steering system 100 further comprises an autopilot system 50 for automatically steering the marine vessel 200 configured to operate according to one or more autopilot modes 51, 52, 53, eventually comprising an autopilot mode selection function to select between any of the autopilot modes 51, 52, 53. The autopilot system 50 comprises at least a motor steering autopilot mode 51 where the autopilot system 50 is configured to automatically control the rudder steering mechanism 30 in order to lock the rudders 31, 32 at a fixed angle, and based on a feedback from the navigation system 40 to independently and dynamically adjust power supply 15', 16' to each of the port side propeller 21 and of the starboard side propeller 22 respectively by independently and dynamically regulating electric power supply 15, 16 to the respective electric motors 11, 12 via respective motor control units 13, 14 in order to maintain the vessel 200 on course 42. In particular, the autopilot system 50 in the motor steering autopilot mode 51 is configured to dynamically correct the bow heading 43 in order to counteract the actual lateral forces 44 acting on the vessel 200 as the vessel position 41 advances and to maintain the vessel 200 on the intended course 42 by independently and dynamically adjusting the electric power supply 15, 16 to each of the port side motor 11 and starboard side motor 12, while maintaining the angle of the rudders 31, 32 fixed with respect to the bow heading 43. The port side rudder 31 and the starboard side rudder 32 are in this example located aft with respect to the port side propeller 21 and to the starboard side propeller 22 respectively. According to this embodiment, the fixed rudder angle is an angle at which the rudders 31, 32 are parallel to the longitudinal axis of the vessel 200 that is in line with the bow heading 43.

The autopilot system 50 may be configured to maintain a constant average vessel velocity or a constant average total electric power consumption 15, 16 or to provide an option to select between the two.

According to an embodiment, the dynamic electric power adjustment 15, 16 is further based on any one or more actual data from any one or more additional sensors 60 or data sources, the data including any one or more of wind direction, water current direction, wave direction, swell, depth, yaw, pitch, roll.

The autopilot system 50 in the motor steering autopilot mode 51 is responsive to a manual change of vessel velocity and/or manual change of course 42 by re-adjusting the electric power supply 15, 16 to each of the port side propeller 21 and of the starboard side propeller 22, while maintaining the rudders angle fixed. A manual change of course 42 may be enabled e.g. by digital control units 71, the pressing of which may result in a change of the bow heading 43 either towards left or towards right, e.g. stepwise in steps of 1 degree, 5 degrees, 10 degrees. Similarly, digital control units 72, the pressing of which may result in a manual change of vessel velocity, e.g. by a stepwise increase or decrease of vessel velocity, may be used.

The vessel steering system 100 further comprises a throttle mechanism 80 comprising two independent handles 81, 82 for individual manual control of electric power supply 15, 16 to each electric motor 11, 12 respectively, where individual manual control of electric power supply 15, 16 to each electric motor 11, 12 is disabled when the autopilot system 50 is activated, at least in the motor steering autopilot mode 51. In particular, when the autopilot system 50 is activated, only manual control of vessel velocity either via digital control units 72 or by synchronous actuation of the throttle mechanism 80 is enabled. Also, manual control of the steering wheel 33 is disabled when the autopilot system 50 is activated. In general, manual control of the rudder steering mechanism 30 is disabled when the autopilot system 50 is activated, in any autopilot mode, and enabled as soon as the autopilot system 50 is deactivated.

FIG. 2 shows schematically the same marine vessel 200 of FIG. 1, where the autopilot system 50 comprises an autopilot mode selection function and is further configured to operate according to an additional rudder steering autopilot mode 52 and where this has been selected. According to the rudder steering autopilot mode 52 the autopilot system 50 is configured to maintain the electric power supply 15, 16 to each of the electric motors 11, 12 constant and to automatically and dynamically control the rudder steering mechanism 30, by dynamically adjusting the rudders angle θ with respect to the longitudinal axis of the vessel or bow heading 43, thus correcting the bow heading 43 in order to counteract the actual lateral forces 44 acting on the vessel 200 as the vessel position 41 advances and to maintain the vessel 200 on the intended course 42. In this example, the electric power supply 15, 16 to both electric motors 11, 12 is the same, but it may be respectively different, although constant, in other cases.

FIG. 3 shows schematically the same marine vessel 200 of FIG. 1 and FIG. 2, where the autopilot system 50 comprises an autopilot mode selection function and is further configured to operate according to an additional hybrid steering autopilot mode 53 and where this has been selected. According to the hybrid steering autopilot mode 53 the autopilot system 50 is configured to independently and dynamically regulate power supply 15, 16 to each of the electric motors 11, 12 respectively, and also to automatically and dynamically control the rudder steering mechanism 30 by dynamically adjusting the rudders angle θ with respect to the longitudinal axis of the vessel or bow heading 43, thus correcting the bow heading 43, by the combined action of electric power control and rudder angle control, in order to counteract the actual lateral forces 44 acting on the vessel 200 as the vessel position 41 advances and to maintain the vessel 200 on the intended course 42.

FIG. 4 shows the same vessel 200 of FIG. 1 in the motor steering autopilot mode 51, where the rudder angle is fixed, with the difference that according to this embodiment, the fixed rudder angle is an empirically determined angle θ at which effective average total electric power consumption 15, 16 is minimum at a certain vessel velocity for the intended course 42. The angle θ remains fixed at least until a willful change of vessel velocity or change of intended course 42 occurs or if the total electric power consumption 15, 16 significantly changes along the course 42, in which case a new angle θ may be determined and fixed.

FIG. 5 shows a marine vessel 200' that is a variant of the marine vessel 200 of FIG. 1-4, where the rudders 31, 32 are located forward with respect to the propulsors 21, 22 respectively. This configuration may be more typical in case of the electric motors 11, 12 being connected to the respective propulsors 21, 22 via e.g. a saildrive transmission system comprising a vertical intermediate shaft extending downward through the respective hulls 201, 202 that connects to propeller shafts 23', 24' respectively. The autopilot system 50 is in the motor steering autopilot mode 51. According to this embodiment, the fixed rudder angle is an angle θ at which the rudders 31, 32 are parallel to the intended course 42, the angle θ remaining fixed as long as the intended course 42 remains fixed. Of course, the autopilot system 50 may be configured to operate according to any of the other autopilot modes 52, 53 or according to different embodiments of the autopilot mode 51, as described above, also in connection to this variant of the marine vessel 200'.

In the preceding specification, numerous specific details are set forth in order to provide a thorough understanding of the present disclosure. It will be apparent, however, to one having ordinary skill in the art that the specific detail need not be employed to practice the present teaching. In other instances, well-known materials or methods have not been described in detail in order to avoid obscuring the present disclosure.

Particularly, modifications and variations of the disclosed embodiments are certainly possible in light of the above description. It is therefore to be understood, that within the scope of the appended claims, the invention may be practiced otherwise than as specifically devised in the above examples.

Reference throughout the preceding specification to "one embodiment", "an embodiment", "one example" or "an example", means that a particular feature, structure or characteristic described in connection with the embodiment or example is included in at least one embodiment. Thus, appearances of the phrases "in one embodiment", "in an embodiment", "one example" or "an example", in various places throughout this specification are not necessarily all referring to the same embodiment or example.

Furthermore, the particular features, structures, or characteristics may be combined in any suitable combinations and/or sub-combinations in one or more embodiments or examples.

The invention claimed is:

1. An autopilot system for automatically steering a marine vessel, the marine vessel comprising two electric motors respectively connected to a port side propulsor and to a starboard side propulsor, a port side rudder and a starboard side rudder and a rudder steering mechanism, the rudder steering mechanism comprising at least one rudder angle feedback sensor, and a satellite-based navigation system for determining the vessel position with respect to an intended course, wherein the autopilot system is configured to operate according to one or more autopilot modes, comprising at least a motor steering autopilot mode, wherein the autopilot system is electronically connected to the rudder steering mechanism, and based on a feedback from the at least one rudder angle feedback sensor automatically controls the rudder steering mechanism so that the rudders are locked at a fixed angle at which the rudders cause the least hydrodynamic resistance, and wherein the autopilot system based on a feedback from the satellite-based navigation system independently and dynamically adjusts power supply to each of the port side propulsor and of the starboard side propulsor by independently and dynamically regulating electric power supply to the respective electric motors in order to maintain the vessel on the intended course, wherein the locking of the rudders and the regulation of electric power supply in the motor steering autopilot mode reduces power consumption at a certain vessel velocity or increases vessel velocity at a certain power consumption, while preserving the option to use the rudder steering mechanism for direction control at least in manual mode.

2. The autopilot system according to claim 1, wherein the autopilot system is configured to maintain a constant average vessel velocity and/or a constant average total electric power consumption.

3. The autopilot system according to claim 1, wherein the fixed angle is an angle at which the rudders are parallel to a longitudinal axis of the vessel or bow heading or is an angle at which the rudders are parallel to the intended course.

4. The autopilot system according to claim 3, wherein the fixed angle is an angle at which the rudders are parallel to the longitudinal axis of the vessel or bow heading if the rudders are located aft with respect to the propulsors respectively and/or if the vessel comprises a port side keel and a starboard side keel aligned with the respective rudders and propulsors.

5. The autopilot system according to claim 3, wherein the fixed angle is an angle at which the rudders are parallel to the intended course if the rudders are located forward with respect to the propulsors.

6. The autopilot system according to claim 1, wherein the fixed angle is an empirically determined angle at which effective average total electric power consumption is minimum at a certain vessel velocity for the intended course.

7. The autopilot system according to claim 1, wherein the autopilot system is responsive to a manual change of vessel velocity and/or manual change of course by re-adjusting the power supply to each of the port side propulsor and of the starboard side propulsor, while maintaining the rudders angle fixed.

8. The autopilot system according to claim 1, wherein the dynamic power adjustment is further based on any one or more actual data from any one or more additional sensors or data sources, the data including any one or more of wind direction, water current direction, wave direction, swell, depth, yaw, pitch, roll.

9. The autopilot system according to claim 1, wherein the autopilot system comprises an autopilot mode selection function and is further configured to operate according to one or more additional autopilot modes selected from a rudder steering autopilot mode and a hybrid steering autopilot mode.

10. The autopilot system according to claim 9, wherein according to the rudder steering autopilot mode the autopilot system is configured to maintain the electric power supply to each of the electric motors constant and to automatically and dynamically control the rudder steering mechanism in order to maintain the vessel on course, and wherein according to the hybrid steering autopilot mode the autopilot system is configured to independently and dynamically regulate electric power supply to the respective electric motors and also to automatically and dynamically control the rudder steering mechanism in order to maintain the vessel on course.

11. The autopilot system according to claim 10, wherein the electric power supply to both electric motors is the same in the rudder steering autopilot mode.

12. The autopilot system according to claim 1, wherein manual control of the rudder steering mechanism is disabled when the autopilot system is activated and enabled when the autopilot system is deactivated.

13. A marine vessel comprising the autopilot system according to claim 1 for automatically steering the marine vessel, the two independently controllable electric motors, the port side propulsor, the starboard side propulsor, the port side rudder, the starboard side rudder, the rudder steering mechanism, and the satellite-based navigation system of claim 1.

14. The marine vessel according to claim 13, further comprising a throttle mechanism comprising two independent handles for individual manual control of electric power supply to each electric motor respectively, wherein individual manual control of electric power supply to each electric motor is disabled when the autopilot system is activated.

15. The marine vessel according to claim 13, further comprising a rechargeable battery pack as electric power supply for the electric motors and at least one renewable energy source for recharging the battery pack.

* * * * *